US007850064B2

(12) United States Patent
McLeod

(10) Patent No.: US 7,850,064 B2
(45) Date of Patent: Dec. 14, 2010

(54) FOOD-TRANSPORT CONTAINER WITH MONOPLANAR MULTIPART END PANELS

(75) Inventor: Michael B. McLeod, Romeoville, IL (US)

(73) Assignee: TIN Inc., Austin, TX (US)

( * ) Notice: Subject to any disclaimer, the term of this patent is extended or adjusted under 35 U.S.C. 154(b) by 211 days.

(21) Appl. No.: 12/354,725

(22) Filed: Jan. 15, 2009

(65) Prior Publication Data

US 2009/0188829 A1 Jul. 30, 2009

Related U.S. Application Data

(60) Provisional application No. 61/024,133, filed on Jan. 28, 2008.

(51) Int. Cl.
*B65D 5/28* (2006.01)

(52) U.S. Cl. ..... 229/143; 229/147; 229/170; 229/174; 229/918

(58) Field of Classification Search ..... 229/143, 229/147, 170, 171, 174, 180, 915, 918, 919
See application file for complete search history.

(56) References Cited

U.S. PATENT DOCUMENTS 667,112 A * 1/1901 Beers ..... 229/147
2,868,430 A * 1/1959 Hamilton ..... 229/915
3,118,591 A 1/1964 Allard
3,545,666 A * 12/1970 Visvydas ..... 229/918
3,704,823 A * 12/1972 Howe ..... 229/143
3,810,574 A * 5/1974 Gardner ..... 229/170
3,871,570 A 3/1975 Garmon
4,537,344 A 8/1985 Thomas
4,883,221 A * 11/1989 Brundage ..... 229/143
5,052,615 A 10/1991 Ott et al.
5,163,609 A 11/1992 Muise, Jr.
5,979,746 A 11/1999 McLeod et al.
6,481,619 B1 11/2002 Jackson
7,017,798 B2 3/2006 Pope et al.
7,484,655 B2 * 2/2009 McLeod ..... 229/143
7,665,654 B2 * 2/2010 McLeod ..... 229/143
2005/0236466 A1 10/2005 McLeod
2006/0231603 A1 10/2006 McLeod

FOREIGN PATENT DOCUMENTS

FR 2669301 11/1990
GB 2229426 9/1990

* cited by examiner

*Primary Examiner*—Gary E Elkins
(74) *Attorney, Agent, or Firm*—Barnes & Thornburg LLP

(57) ABSTRACT

A container is adapted to transport food or other articles. The container includes a floor, two side walls, a front end closure coupled to the side walls, and a rear end closure coupled to the side walls.

25 Claims, 8 Drawing Sheets

218
258R
351P
351A
351C
346R
344
348
328T
346L'
346L
230E
352P
258L
218
351P'
351A'
349R
350'R
350'C
347
349L
350'L
353L
352C
352A
242
242'
224
2342
2341
234
214
212
221W
221
350W
A
TD
216
2361
2362
236
226
238
238'
219W
219
250W
251A
251C
251A'
251P'
253R
250'R
250
250'C
247
250'L
249L
253L
252C
252A'
252P'
252A
257R
251P
246R
246R'
249R
244
248
228T
246L'
246L
252P
228E
257L

FOOD-TRANSPORT CONTAINER WITH MONOPLANAR MULTIPART END PANELS

This application claims priority under 35 U.S.C. §119(e) to U.S. Provisional Application No. 61/024,133, filed Jan. 28, 2008, which is expressly incorporated by reference herein.

BACKGROUND

The present disclosure relates to trays and containers, and particularly to trays and containers made of paperboard. More particularly, the present disclosure relates to a sturdy tray or container made of a corrugated material and configured to contain food or other items.

SUMMARY

An article-transport container or tray is adapted to transport food or other articles from one site to another. The container includes a floor, two side walls, a front end closure coupled to the floor and the side walls, and a rear end closure coupled to the floor and the side walls. These walls and closures cooperate to form an interior article-receiving region above the floor.

In illustrative embodiments, each of the front and rear end closures comprises a monoplanar multipart end panel. The front end closure includes a narrow-width front end wall coupled to a first end of the floor and sized to have a width that is narrower than the width of the first end of the floor. The front end closure also includes a front anchor strip coupled to the narrow-width front end wall and to each of the side walls in the container. Two auxiliary anchor flaps included in the front anchor strip are arranged to lie in spaced-apart relation to one another to locate the narrow-width front end wall therebetween and to cooperate with the narrow-width front end wall to define the monoplanar multipart end panel of the front end closure.

In illustrative embodiments, each of the front and rear end closures includes a narrow-width end wall and separate right and left anchor strips coupled to the narrow-width end wall and also coupled to the side walls to retain the end wall in an upright orientation relative to the floor and in fixed relation to the upright left and right side walls. Each of the separate right and left anchor strips included in the front and rear end closures includes a corner stacking pad so as to provide a total of four corner stacking pads in each container. Overlying containers are supported by these corner stacking pads when containers are stacked.

In some illustrative embodiments, the container further includes separate front and rear top closures. Each of the front and rear top closures is coupled to a companion narrow-width end wall and is formed, in one embodiment, to include a T-shaped lid section located between the corner stacking pad of its right anchor strip and the corner stacking pad of its separate left anchor strip. In another illustrative embodiment, the container of each of the front and rear top closures further includes a pentagon-shaped lid instead of a T-shaped lid.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 9 is a perspective view of a container with monoplanar multipart end panels in accordance with a second embodiment of the present disclosure showing four triangle-shaped corner stacking pads included in the separate right and left anchor strips included in each of the front and rear end closures;

FIG. 10 is a top plan view of the container of FIG. 9;

FIG. 11 is a plan view of a blank of corrugated material used to form the container of FIGS. 9 and 10 showing a somewhat trapezoid-shaped lid section (at the bottom of the page) coupled to the narrow-width end panel of the front end closure and located between the right and left corner stacking pads of the separate right and left anchor strips and also showing a similar lid section (at the top of the page) in the rear end closure (at the bottom of the page);

DETAILED DESCRIPTION

Figure 1:
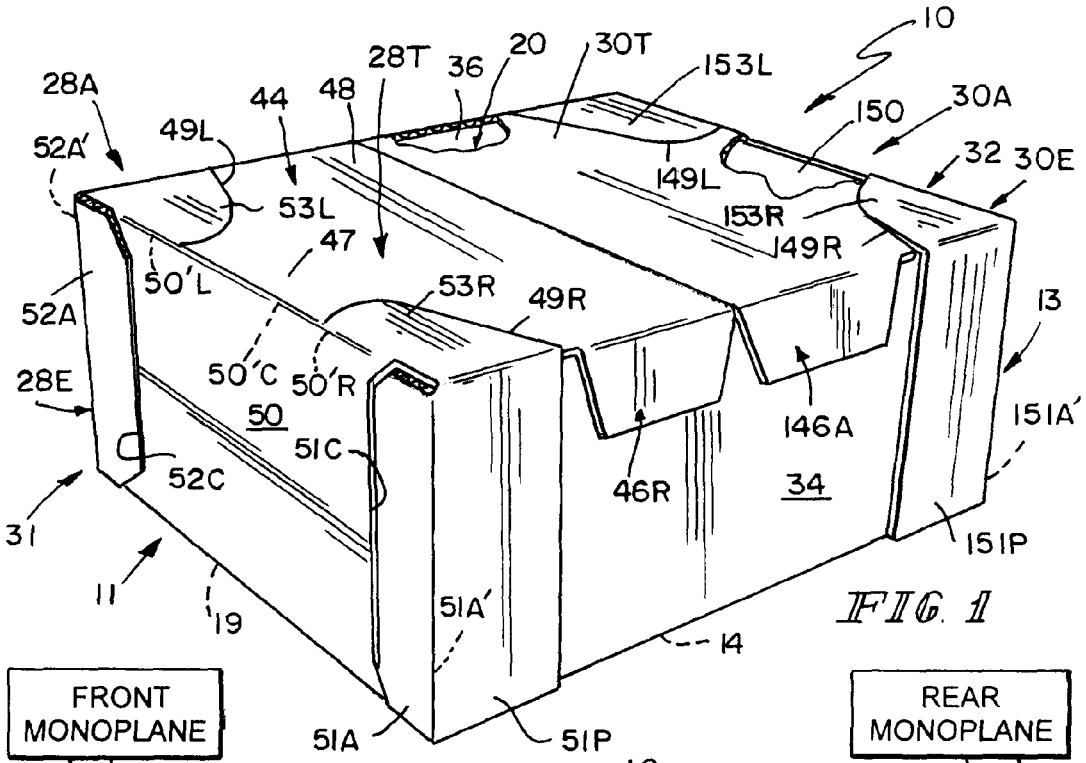
FIG. 1 is a perspective view of an erected, fully enclosed food-transport container with monoplanar multipart end panels in accordance with a first embodiment of the present disclosure showing (on the left) a front end closure comprising a narrow-width front end wall coupled to separate horizontal front left and right corner stacking pads and located between two spaced-apart auxiliary pad anchor flaps included in the front end closure and associated with the front left and right corner stacking pads and showing that the two spaced-apart auxiliary pad anchor flaps and the narrow-width front end wall located therebetween lie in the same plane and cooperate to define a front monoplanar multipart end panel having a generally planar exterior surface and also showing separate rear left and right corner stacking pads and two T-shaped lid sections located between the four corner stacking pads.
Figure 2:
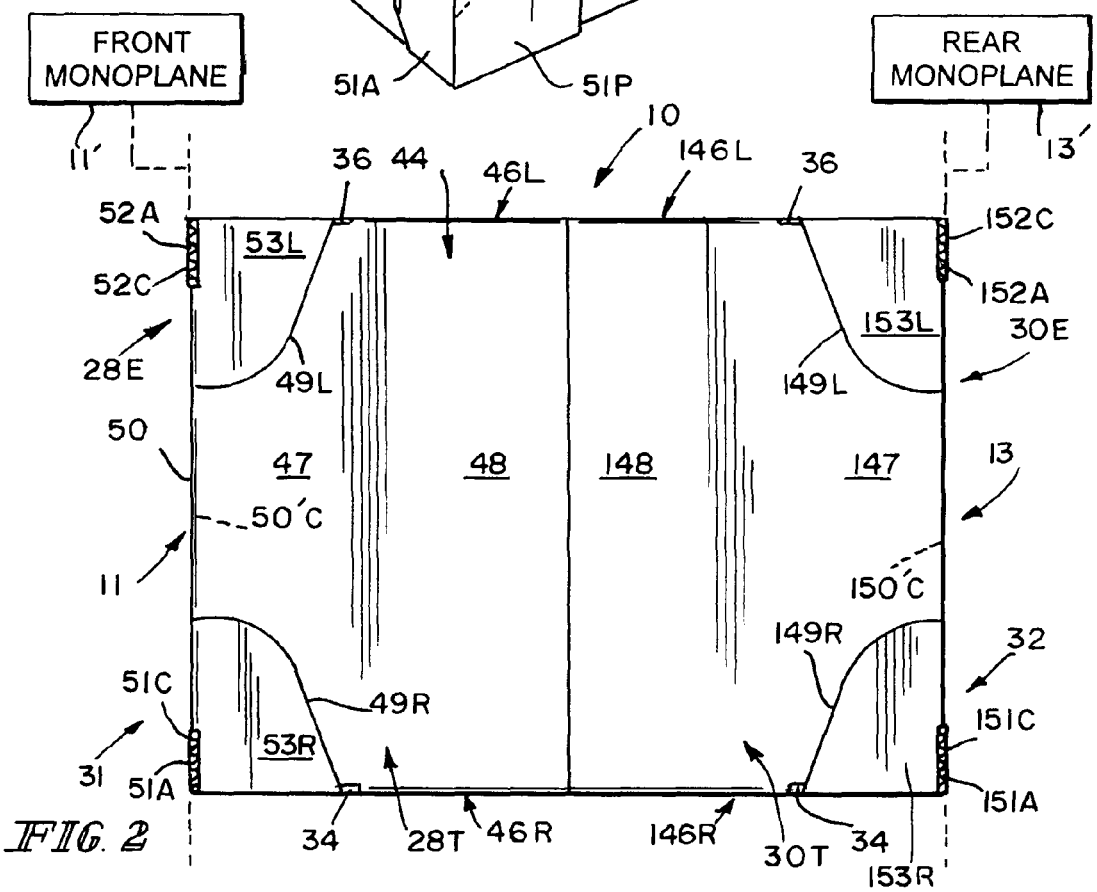
FIG. 2 is a top plan view of the food-transport container of FIG. 1 showing a front monoplanar multipart end panel included in the front end closure (on the left end of the container) and a rear monoplanar multipart end panel included in a rear end closure (on the right end of the container) and showing the four corner stacking pads included in the separate right and left anchor strips included in each of the front and rear end closures.

A fully enclosed article-transport container 10 is provided, as shown in FIGS. 1 and 2, for carrying various items. Container 10 is configured to include front and rear monoplanar multipart end panels 11 and 13 as suggested in FIG. 2. Each of end panels 11, 13 comprises multiple parts that cooperate to form an exterior surface that lies in a single plane (i.e., monoplane). As suggested in FIG. 2, the exterior surface of front end panel 11 lies in front monoplane 11'. The exterior surface of rear end panel 13 lies in rear monoplane 13' as suggested in FIG. 2.

Figure 9:
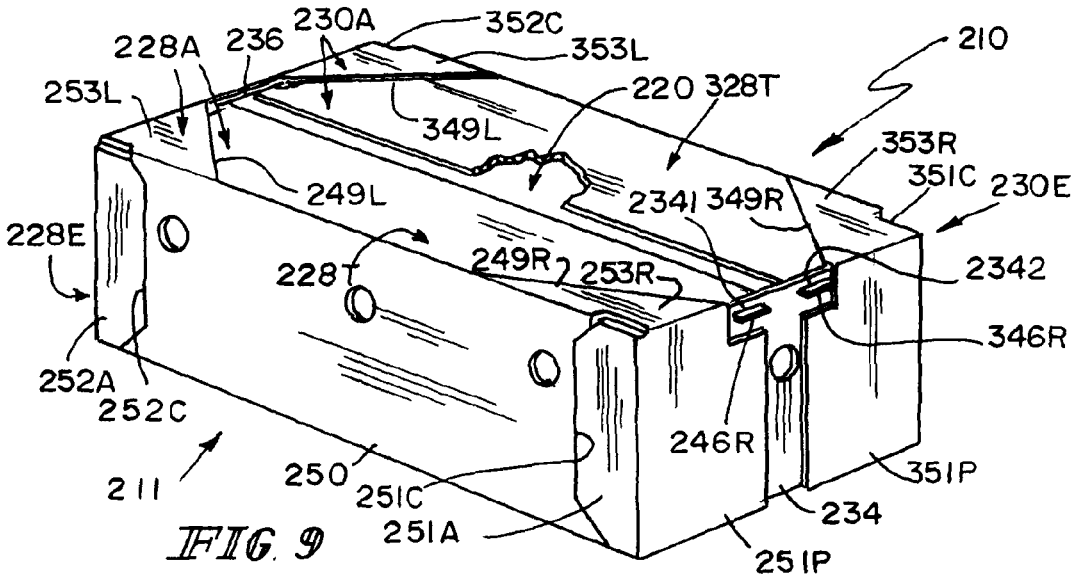
FIGS. 9-11 relate to a fully enclosed container wherein the width of each of the front and rear end closures is greater than the length of the left and right side walls.
Figure 10:
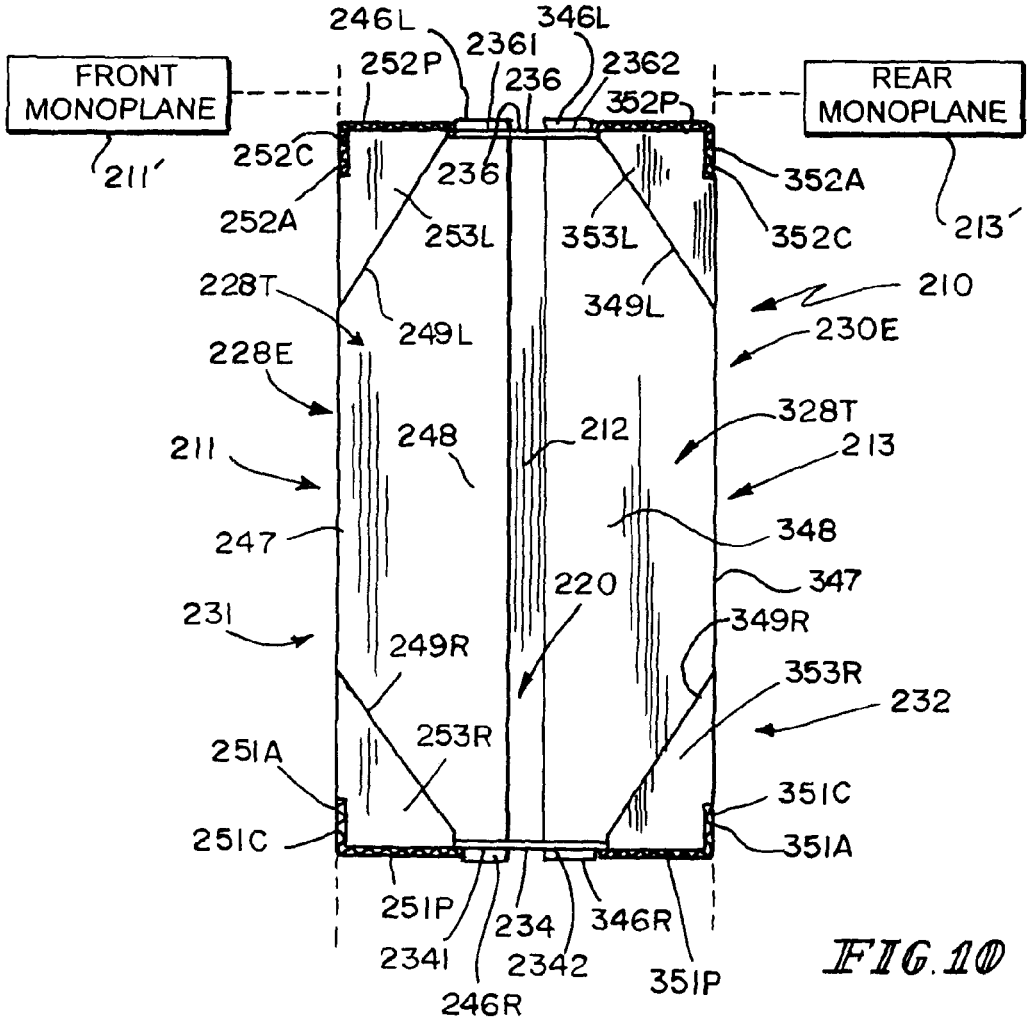
Figure 11:
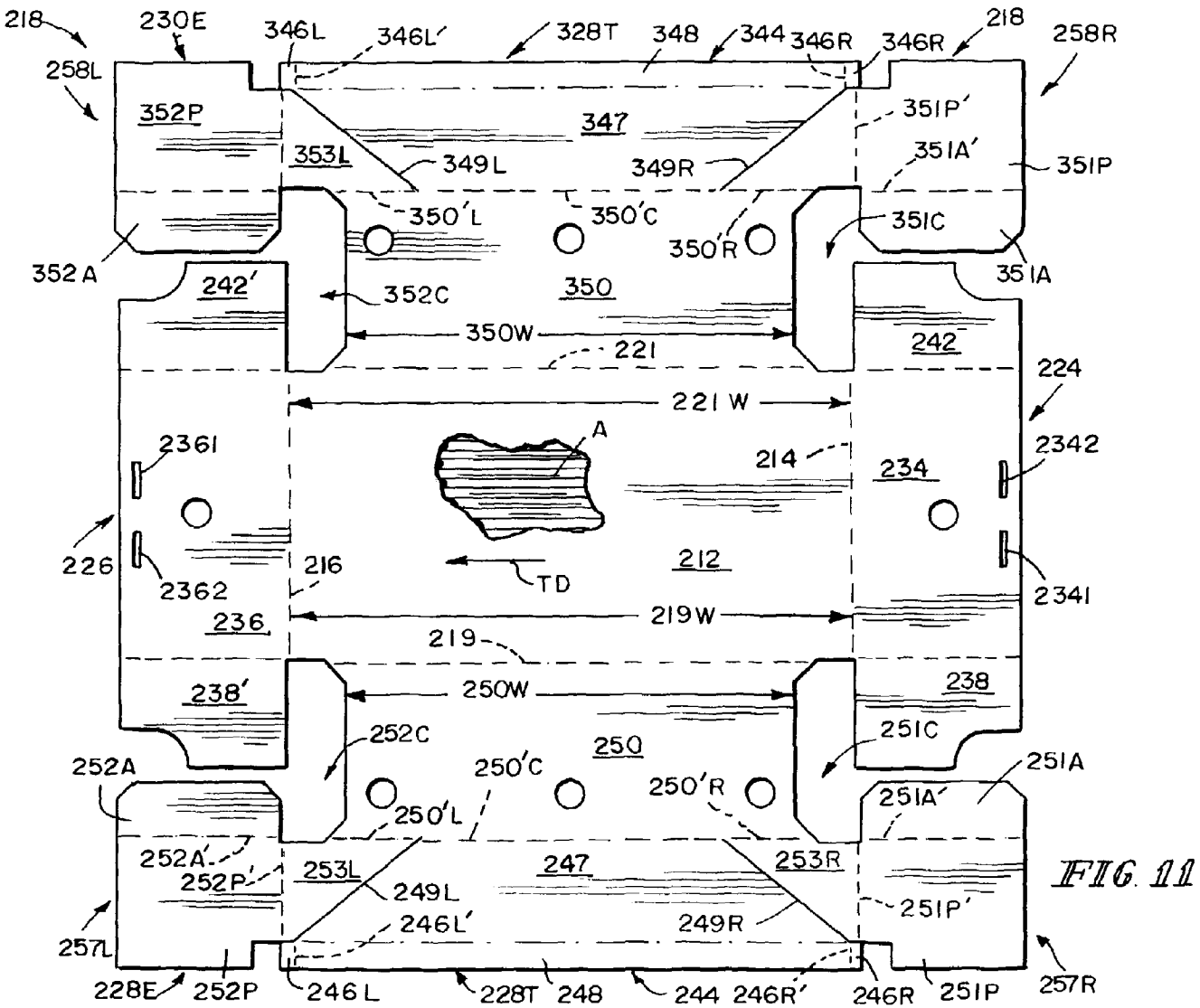

Another embodiment of a fully enclosed container having front and rear monoplanar multipart end panels is illustrated in FIGS. 9-11. Other embodiments, in accordance with the present disclosure, of blanks of corrugated material that can be folded to form open containers (i.e., containers that are not fully enclosed) including monoplanar multipart end panels are shown, for example, in FIGS. 12 and 13.

Container 10 is formed to include an interior region 20 for receiving various items such as fruits, vegetables, or any type of agricultural or meat product (not shown). Container 10 is well-suited to carry a wide variety of other items, articles, or products.

Figure 3:
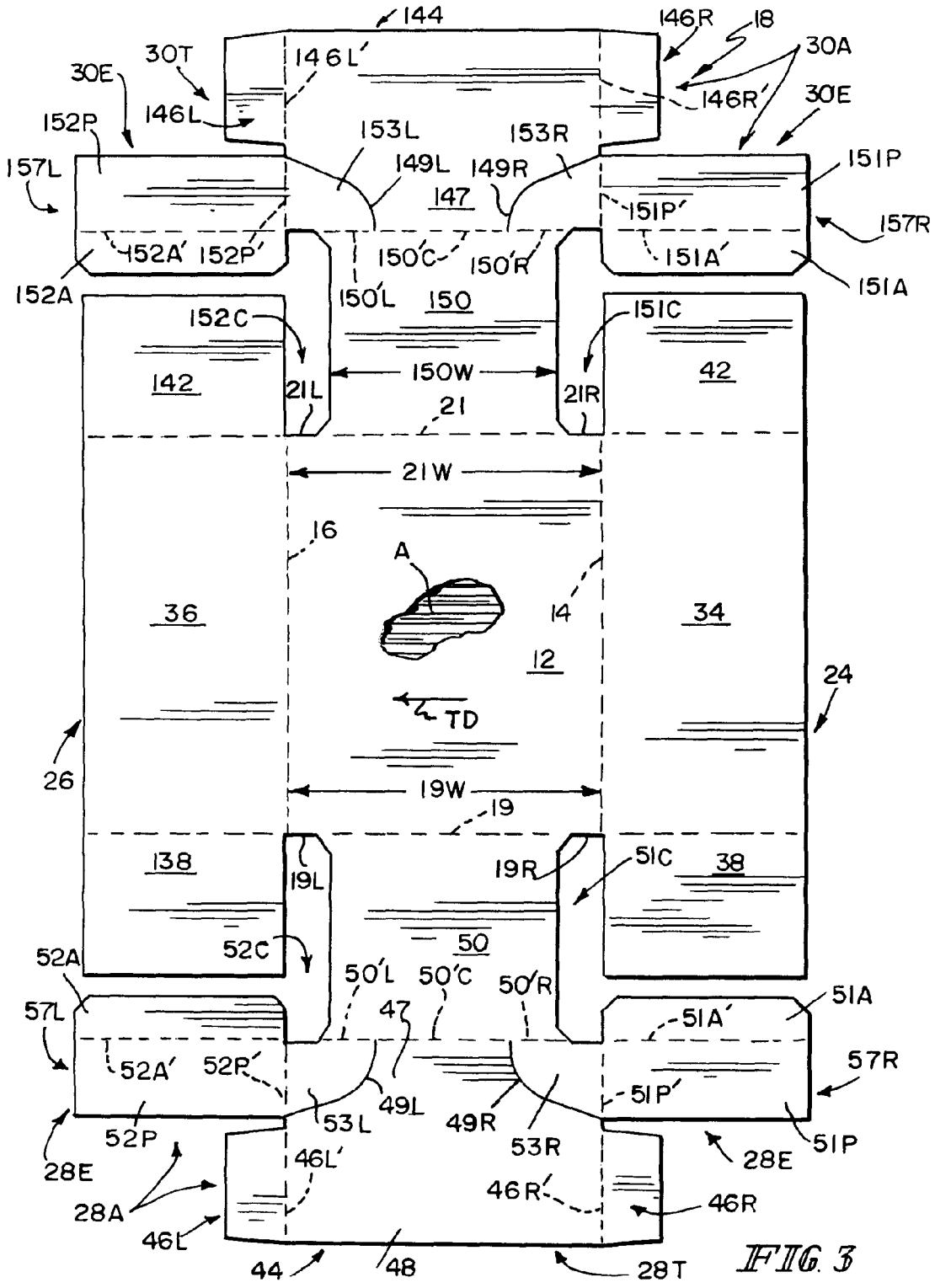
FIG. 3 is a plan view of a blank of corrugated material used to form the container of FIGS. 1 and 2 and showing that the unfolded front end closure (at the bottom of the page) includes a narrow-width front end wall coupled to a floor having a relatively wider front edge and a front end wall anchor system including a right front anchor strip comprising, in series, from right to left, the first auxiliary pad anchor flap, a first primary pad anchor flap, and the front right corner stacking pad (coupled to the narrow-width front end wall), a separate left front anchor strip comprising, in series, from right to left, the front right corner stacking pad (coupled to the narrow-width front end wall), a second primary pad anchor flap, and a second auxiliary pad anchor flap, and a front top closure comprising a T-shaped lid section located between the left and right corner stacking pads and two lid anchor flaps coupled to free portions of the T-shaped lid section and showing a similar rear end wall anchor system (at the top of the page) comprising an unfolded rear end closure and rear top closure.

Container 10 is made, for example, from a blank 18 of corrugated material, as shown in FIG. 3. Blank 18 includes floor 12, a right side strip 24 appended to floor 12 along a first side fold line 14, a left side strip 26 appended to floor 12 along a second side fold line 16, a front end closure 28E appended to floor 12 along first end fold line 19, and a rear end closure 30E appended to floor 12 along second end fold line 21. Right side strip 24, left side strip 26, front end closure 28, and rear end closure 30 cooperate to form a border coupled to floor 12 and arranged to cooperate with floor 12 to form interior region 20.

Figure 4:
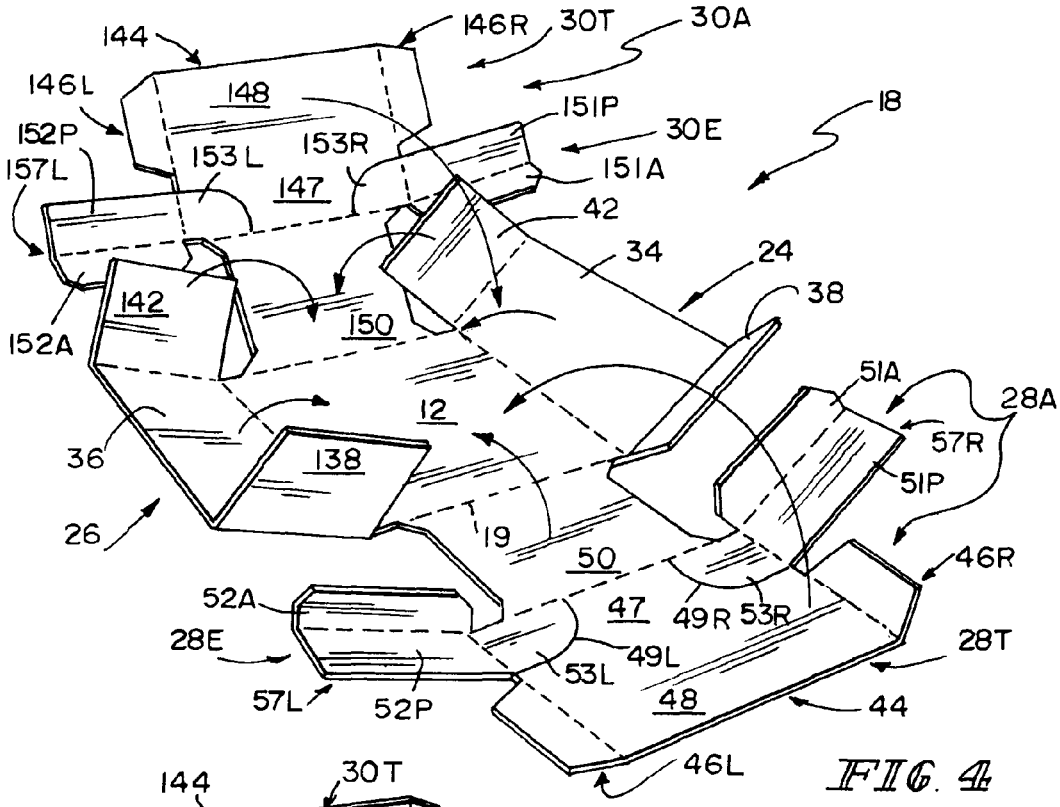
FIG. 4 is a perspective view of the blank of FIG. 3 being folded to erect the narrow-width rear end wall and left and right side walls and showing folding movement of each of the four auxiliary pad anchor flaps included in the front and rear end closures about a fold line relative to a companion primary pad anchor flap.

Rear end closure 30E is configured to be folded as suggested in FIG. 4 to produce a rear end 32 of container 10 as suggested in FIGS. 1 and 2. Front end closure 28E is configured to be folded as suggested in FIG. 5 to produce a front end 31 of container 10 as suggested in FIGS. 1 and 2. It is within the scope of the present disclosure to make blank 18 from a variety of materials including corrugated paperboard, folding carton, and solid fiber and other materials such as plastic sheeting and plastic corrugated.

Right side strip 24 includes a right side wall 34, a first front end wall anchor flap 38, and a first rear end wall anchor flap 42 as shown in FIG. 3. Right side wall 34 is appended to floor 12 along first side fold line 14.

Left side strip 26 includes a left side wall 36, a second front end wall anchor flap 138, and a second rear end wall anchor flap 142 as shown in FIG. 3. Left side wall 36 is appended to floor 12 along second side fold line 16.

Front end closure 28E includes a narrow-width front end wall 50 coupled to one end of floor 12 along first end fold line 19 and separate right and left front anchor strips 57R, 57L coupled to front end wall 50 along strip fold lines 50'R and 50'L, respectively, as suggested in FIGS. 3 and 4. The width 50W of front end wall 50 is narrow as compared to the width 19W of floor 12 as shown in FIG. 3. Front anchor strips 57R, 57L provide means for anchoring front end wall 50 to each of right and left side walls 34, 36 to establish front end 31 of container 10 as suggested in FIGS. 1 and 5. Right front anchor strip 57R is coupled to right side strip 24 to anchor narrow-width front end wall 50 in substantially perpendicular relation to floor 12 to establish an upright orientation of narrow-width front end wall 50. Left front anchor strip 57L is coupled to left side strip 26 to anchor narrow-width front end wall 50 to left side strip 26 to retain narrow-width front end wall 50 in the upright orientation.

Front end wall 50 has a width 50W that is less than the width 19W of floor 12 along fold line 19 as suggested in FIG. 3. In the illustrated embodiment, narrow-width front end wall 50 is centered relative to floor 12 along first end fold line 19 to produce front left edge 19L of floor 12 and front right edge 19R of floor 12. Front left edge 19L is about equal in length to front right edge 19R.

Figure 6:
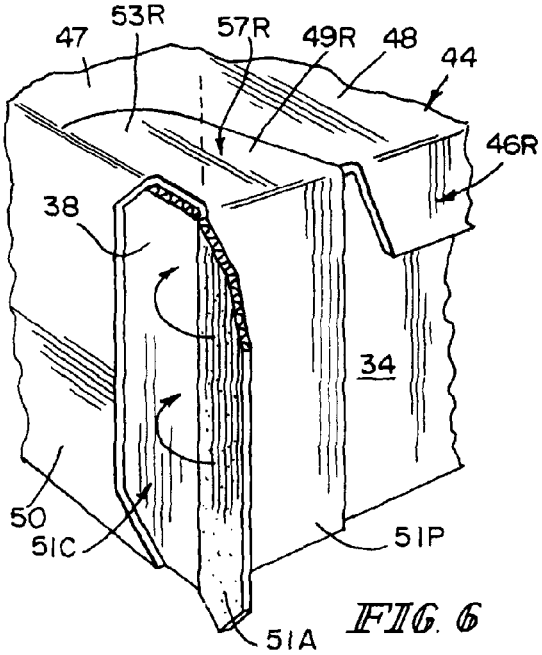
FIG. 6 is an enlarged partial view of a front right corner of the container of FIG. 1 after the first primary pad anchor flap in the right front anchor strip has been mated with the right side wall but before final folding movement of the first auxiliary pad anchor flap in the right front anchor strip about a vertical axis along a fold line provided between the first auxiliary and primary pad anchor flaps into a flap-receiving channel located next to a vertically extending first edge of the upright narrow-width front end wall.
Figure 7:
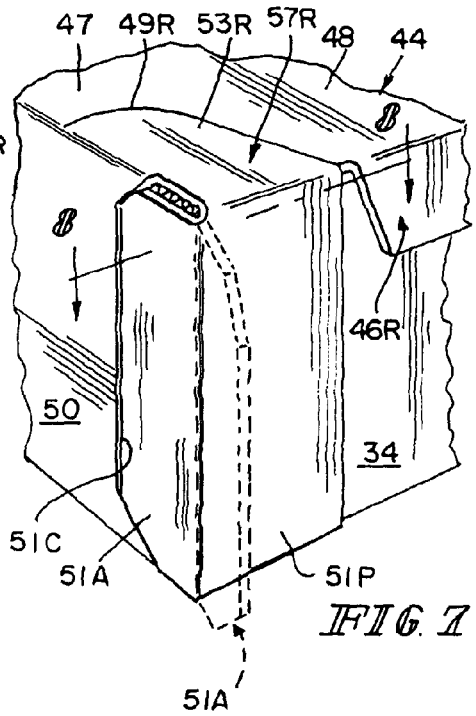
FIG. 7 is a view similar to FIG. 6 following folding movement of the first auxiliary pad anchor flap into the flap-receiving channel to lie in generally edge-to-edge relation with the upright narrow-width front end wall.
Figure 8:
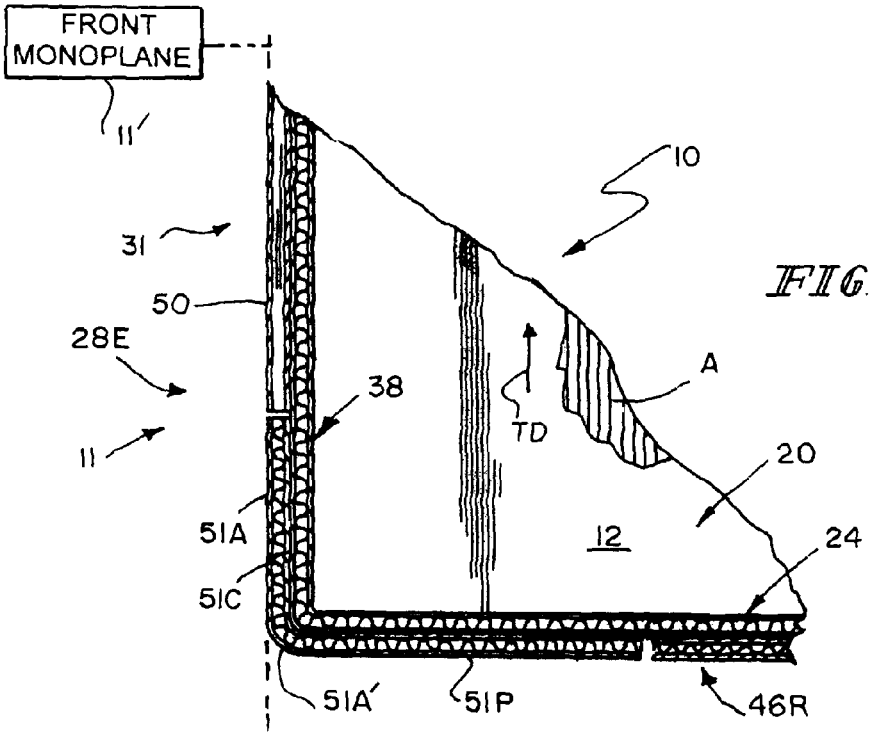
FIG. 8 is an enlarged sectional view taken along line 8-8 of FIG. 7 showing that the exterior surfaces of the narrow-width front end panel and the first auxiliary pad anchor flap of the right anchor strip lie in generally the same plane (shown in phantom) to define a portion of the monoplanar multipart end panel in the front end closure and showing that the container is characterized by a 90° outside corner and a 90° inside corner.

Right front anchor strip 57R includes a front right corner stacking pad 53R coupled to front end wall 50 along front right anchor strip fold line 50'R, a first primary pad anchor flap 51P coupled to one edge of pad 53R along a first primary anchor flap fold line 51P', and a first auxiliary pad anchor flap 51A coupled to first primary pad anchor flap 51P along a first auxiliary anchor flap fold line 51A' as suggested in FIG. 3. First primary pad anchor flap 51P is adapted to mate with right side wall 34 as suggested in FIGS. 1 and 8. First auxiliary pad anchor flap 51A is adapted to mate with first front end wall anchor flap 38 as suggested in FIGS. 6-8.

Left front anchor strip 57L includes a front left corner stacking pad 53L coupled to front end wall 50 along front left anchor strip fold line 50'L, a second primary pad anchor flap 52P coupled to one edge of pad 53L along a second primary anchor flap fold line 52P' as suggested in FIG. 3, and a second auxiliary pad anchor flap 52A coupled to second primary canopy anchor flap 52P along a second auxiliary anchor flap fold line 52A' as suggested in FIG. 3. Front right and left corner stacking pads 53R, 53L are separated and arranged to lie in spaced-apart relation to one another in the blank stage as shown in FIG. 3 and also in the erected stage as shown in FIGS. 1 and 2.

Container 10 further includes a front top closure 28T including a front lid section 44, a right lid anchor flap 46R, and a left lid anchor flap 46L as shown, for example, in FIG. 3. Front lid section 44 is T-shaped in an illustrative embodiment and includes a base 47 coupled to front end wall 50 along a closure fold line 50'C and an elongated wing 48 coupled to base 47 as suggested in FIG. 3. Right lid anchor flap 46R is coupled to a free right end of wing 48 along a right wing fold line 46R'. Left lid anchor flap 46L is coupled to a free left end of wing 48 along a left wing fold line 46L'. Base 47 is separated from right corner stacking pad 53R by a right curved cut line 49R and from left corner stacking pad 53L by a left curved cut line 49L as suggested in FIGS. 1-3.

Rear end closure 30E includes a rear narrow-width end wall 150 coupled to an opposite end of floor 12 along a second end fold line 21 and separate right and left rear anchor strips 157R, 157L coupled to rear end wall 150 along strip fold lines 150'R and 150'L, respectively, as suggested in FIG. 3. Rear anchor strips 157R, 157L provide means for anchoring rear end wall 150 to each of right and left side walls 34, 36 to establish rear end 32 of container 10 as suggested in FIGS. 1 and 5.

Rear end wall 150 has a width 150W that is less than the width 21W of floor 12 along fold line 21 as suggested in FIG. 3. In the illustrated embodiment, rear end wall 150 is centered relative to floor 12 along second end fold line 21 to produce rear left edge 21L of floor 12 and rear right edge 21R of floor 12. Rear left edge 21L is about equal in length to right rear edge 21R. Also, in the illustrated embodiment, width 19W is about equal to width 21W as suggested in FIG. 3 owing to the substantially uniform width of floor 12.

Right rear anchor strip 157R includes a rear right corner stacking pad 153R coupled to rear end wall 150 along a rear right anchor strip fold line 150R, a first primary pad anchor flap 151P coupled to one edge of rear pad 153R along a first primary anchor flap fold line 151P', and a first auxiliary anchor flap 151A coupled to first primary pad anchor flap 151P along a first auxiliary anchor flap fold line 151A'. First primary pad anchor flap 151P is adapted to mate with right side wall 34 as suggested in FIGS. 1 and 5. First auxiliary pad anchor flap 151A is adapted to mate with first rear end wall anchor flap 42 as suggested in FIG. 5.

Left anchor strip 157L includes a rear left corner stacking pad 153L coupled to rear end wall 150 along a rear left anchor strip fold line 150'L, a second primary pad anchor flap 152P coupled to an opposite end of rear pad 153R along a second primary anchor flap fold line 152P', and a second auxiliary pad anchor flap 152A coupled to second primary pad anchor flap 152P along a second auxiliary anchor flap fold line 152A' as suggested in FIG. 3. Rear right and left corner stacking pads are separated and arranged to lie in spaced-apart relation to one another in the blank stage as shown in FIG. 3 and in the erected stage as shown in FIGS. 1 and 2.

Container 10 further includes a rear top closure 30T including a rear lid section 144, a right lid anchor flap 146R, and a left lid anchor flap 146L as shown, for example, in FIG. 3. Rear lid section 144 is T-shaped in an illustrative embodiment and includes a base 147 coupled to rear end wall 150 along a closure fold line 150'C and an elongated wing 148 coupled to base 147 as suggested in FIG. 3. Right lid anchor flap 146R is coupled to a right end of wing 148 along a right wing fold line 146R'. Left lid anchor flap 146L is coupled to a left end of wing 148 along a left wing fold line 146L'. Base 147 is separated from right corner stacking pad 153R by a right curved cut line 149R and from left corner stacking pad 153L by a left curved cut line 149L as suggested in FIGS. 1-3.

Front end closure 28E and front top closure 28T cooperate to form a front end awning 28A that mates with right and left side walls 34, 36 to cover a front portion of interior region 20 of container 10 as suggested in FIGS. 1 and 2. Similarly, rear end closure 30E and rear top closure 30T cooperate to form a rear end awning 30A that mates with right and left side walls 34, 36 to cover a rear portion of interior region 20 of container 10 as suggested in FIGS. 1 and 2.

In an illustrative embodiment, the corrugation of blank 18 is positioned to run in a transverse direction TD as shown in insert A in FIG. 3. It is within the scope of the present disclosure to establish each of the fold lines disclosed herein by using score lines, creases, perforations, or perforations and score lines or by using another suitable technique.

Figure 5:
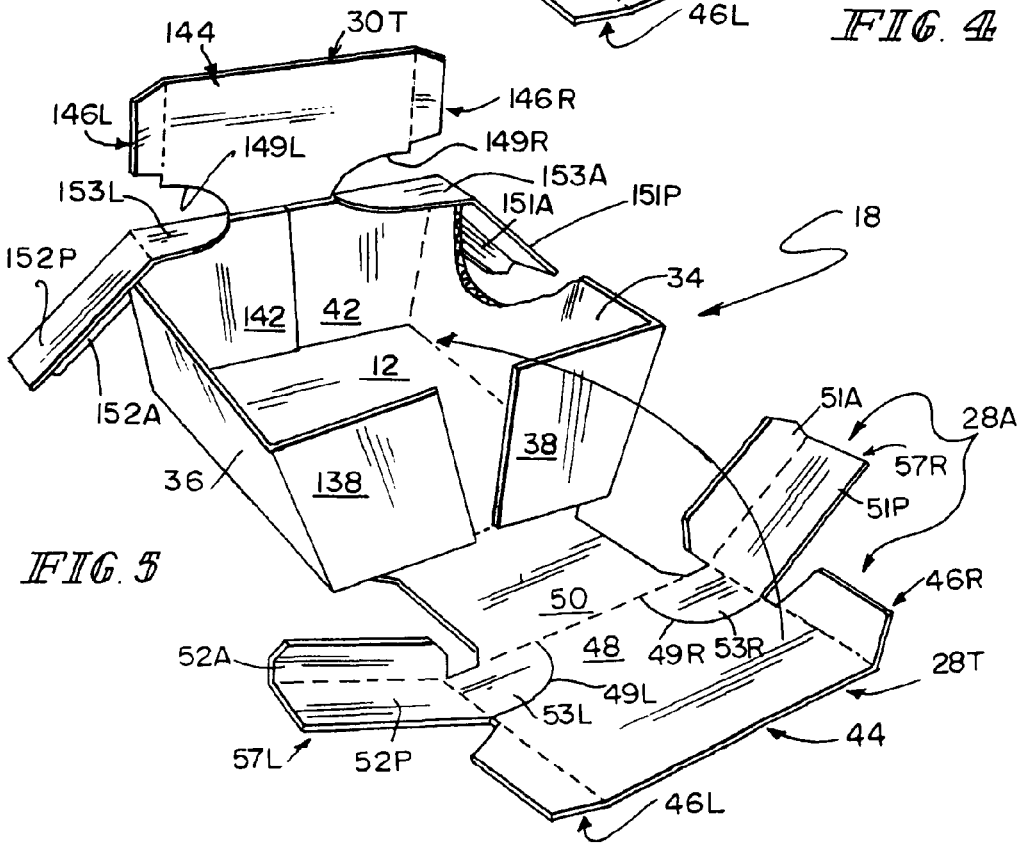
FIG. 5 is a view similar to FIG. 4, with a portion of the right side wall broken away, showing further folding of the companion first auxiliary and primary pad anchor flaps in the rear end closure in a generally clockwise direction and further folding of the companion second auxiliary and primary pad anchor flaps in the rear end closure in a generally counter-clockwise direction.

Blank 18 is folded as shown, for example, in FIGS. 4 and 5 to produce the fully enclosed container 10 shown in FIG. 1. Once blank 18 is folded, primary pad anchor flaps 51P, 52P, 151P, and 152P are used to retain container 10 in an erected condition as suggested in FIG. 1. First primary pad anchor flap 51P is mated, e.g., adhered (using any suitable means), to right side wall 34 and second primary pad anchor flap 52P is mated, e.g., adhered (using any suitable means), to left side wall 36 to form front end closure 28E. Likewise, first primary pad anchor flap 151P is mated, e.g., adhered (using any suitable means), to right side wall 34 and second primary pad anchor flap 152P is mated, e.g., adhered (using any suitable means), to left side wall 36 to form rear end closure 30E.

Next, all of the auxiliary pad anchor flaps 51A, 52A, 151A, and 152A are folded relative to companion primary pad anchor flaps 51P, 52P, 151P, and 152P as suggested in FIG. 5 and moved into welcoming companion flap-receiving channels 51C, 52C, 151C, 152C provided on opposite sides of front and rear end panels 50, 150 as suggested in FIGS. 1 and 2. Such movement of an auxiliary pad anchor flap into a companion flap-receiving channel is shown in more detail in FIGS. 6-8 with respect to auxiliary pad anchor flap 51A and its companion flap-receiving channel 51C. Adhesive (represented by a dot pattern in FIG. 6) or other suitable attachment means is applied, for example, to an interior surface on auxiliary pad anchor flap 51A as suggested in FIG. 6 and flap 51A can be moved to mate with, e.g., adhere to, first front end wall anchor flap 38 as suggested in FIGS. 7 and 8. Other flaps 52A, 151A, and 152A are mated to portions of companion anchor flaps 138, 42, and 142, respectively, in a similar manner.

A fully enclosed article-transport container 210 in accordance with a second embodiment of the present disclosure is provided, as shown in FIGS. 9 and 10, for carrying various items and made using a blank 218 shown in FIG. 11. Container 210 is configured to include front and rear monoplanar multipart end panels 211 and 213 as suggested in FIG. 10. Each of end panels 211, 213 comprises multiple parts that cooperate to form an exterior surface that lies in a single plane (i.e., monoplane). As suggested in FIG. 10, the exterior surface of front end panel 211 lies in front monoplane 211'. The exterior surface of rear end panel 213 lies in rear monoplane 213' as suggested in FIG. 10.

Container 210 is formed to include an interior region 220 (as suggested in FIG. 9) for receiving various items such as fruits, vegetables, or any type of agricultural or meat product (not shown). Container 210 is well-suited to carry a wide variety of other items, articles, or products.

Container 210 is made, for example, from a blank 218 of corrugated material, as shown in FIG. 11. Blank 218 includes floor 212, a right side strip 224 appended to floor 212 along a first side fold line 214, a left side strip 226 appended to floor 212 along a second side fold line 216, a front end closure 228E appended to floor 212 along a first end fold line 219, and a rear end closure 230E appended to floor 212 along a second end fold line 221. Right side strip 224, left side strip 226, front end closure 228, and rear end closure 230 cooperate to form a border coupled to floor 212 and arranged to cooperate with floor 212 to form interior region 220.

Rear end closure 230E is configured to be folded to produce a rear end 232 of container 210 as suggested in FIGS. 9 and 10. Front end closure 228E is configured to be folded to produce a front end 231 of container 210 as suggested in FIGS. 9 and 10. It is within the scope of the present disclosure to make blank 218 from a variety of materials including corrugated paperboard, folding carton, and solid fiber and other materials such as plastic sheeting and plastic corrugated.

Right side strip 224 includes a right side wall 234, a first front end wall anchor flap 238, and a first rear end wall anchor flap 242 as shown in FIG. 11. Right side wall 234 is appended to floor 212 along first side fold line 214. Right side wall 234 is formed to include first and second tab-receiving slots 2341 and 2342. Each such slot is sized to receive one of the lid anchor tabs 246R, 346R included in front and rear top closures 228T, 328T as suggested in FIGS. 9 and 10.

Left side strip 226 includes a left side wall 236, a second front end wall anchor flap 238', and a second rear end wall anchor flap 242' as shown in FIG. 11. Left side wall 236 is appended to floor 212 along second side fold line 216. Left side wall 236 is formed to include first and second tab-receiving slots 2361 and 2362. Each such slot is sized to receive one of the lid anchor tabs 246L, 346L included in front and rear top closures 228T, 328T as suggested in FIG. 10.

Front end closure 228E includes a narrow-width front end wall 250 coupled to one end of floor 212 along a first end fold line 219 and right and left front anchor strips 257R, 257L coupled to front end wall 250 along strip fold lines 250'R and 250'L, respectively, as suggested in FIG. 11. The width 250W of front end wall 250 is narrow as compared to the width 219W of floor 212 as shown in FIG. 11. Front anchor strips 257R, 257L provide means for anchoring front end wall 250 to each of right and left side walls 234, 236 to establish front end 231 of container 210 as suggested in FIGS. 9 and 10. Right front anchor strip 257R is coupled to right side strip 224 to anchor narrow-width front end wall 250 in substantially perpendicular relation to floor 212 to establish an upright orientation of narrow-width front end wall 250. Left front anchor strip 257L is coupled to left side strip 226 to anchor narrow-width front end wall 250 to left side strip 226 to retain narrow-width front end wall in the upright orientation.

Right front anchor strip 257 includes a front right corner stacking pad 253R coupled to front end wall 250 along front right anchor strip fold line 250'R, a first primary pad anchor flap 251P coupled to one edge of front pad 253R along a first primary anchor flap fold line 251P', and a first auxiliary pad anchor flap 251A coupled to first primary anchor flap 251P along a first auxiliary anchor flap fold line 251A' as suggested in FIG. 11. When assembled, first auxiliary pad anchor flap 251A lies in a companion flap-receiving channel 251C.

Left front anchor strip 257L includes a front left corner stacking pad 253L coupled to front end wall 250 along front left anchor strip fold line 250'L, a second primary pad anchor flap 252P coupled to an opposite end of front pad 253L along a second primary anchor flap fold line 252P', and a second auxiliary pad anchor flap 252A coupled to second primary pad anchor flap 252P along a second auxiliary anchor flap fold line 252A' as suggested in FIG. 11. When assembled, second auxiliary pad anchor flap 252A lies in a companion flap-receiving channel 252C.

Container 210 further includes a front top closure 228T including a front lid section 244, a right lid anchor tab 246R, and a left lid anchor tab 246L as shown, for example, in FIG. 11. Front lid section 244 is pentagon-shaped in an illustrative embodiment and includes a trapezoid-shaped base 247 coupled to front end wall 250 along closure fold line 250'C and an elongated rectangular wing 248 coupled to base 247 as suggested in FIG. 11. Right lid anchor tab 246R is coupled to a right end of wing 248 along a right anchor tab line 246R' and sized and located to extend into a tab-receiving slot 2341 formed in right side wall 234 of right side strip 224 (as suggested in FIGS. 9 and 10) to retain front lid section 244 in a closed position relative to right side wall 234. Left lid anchor tab 246L is coupled to a left end of wing 238 along a left anchor tab fold line 246L' and sized and located to extend into a tab-receiving slot 2361 formed in left side wall 236 of left side strip 226 (as suggested in FIG. 10) to retain lid section 244 in a closed position relative to left side wall 236. Base 247 is separated from right corner stacking pad 253R by a right straight cut line 249R and from left corner stacking pad 253L by a left straight cut line 249L as suggested in FIGS. 9-11.

Rear end closure 230E includes a rear narrow-width end wall 350 coupled to an opposite end of floor 212 along a second end fold line 221, a right rear anchor strip 258R coupled to rear end wall 350 along a strip fold line 350'R, and a left rear anchor strip 238L coupled to rear end wall 350 along a strip fold line 350'L as suggested in FIG. 11. Right and left rear anchor strips 258R, 258L cooperate to provide means for anchoring rear end wall 350 to each of right and left side walls 234, 236 to establish rear end 232 of container 210 as suggested in FIGS. 9 and 10.

Right rear anchor strip 258R includes a rear right corner stacking pad 353R coupled to end wall 350 along a rear right anchor strip fold line 350R', a first primary pad anchor flap 351P coupled to one edge of rear pad 353R along a first primary anchor flap fold line 351P', and first auxiliary pad anchor flap 351A coupled to first primary pad anchor flap 351P along a first auxiliary anchor flap fold line 351A' as suggested in FIG. 11. When assembled, first auxiliary pad anchor flap 351A lies in a companion flap-receiving channel 351C.

Left rear anchor strip 258L includes a rear left corner stacking pad 353L coupled to rear end wall 350 along a rear left anchor strip fold line 350'L, a second primary pad anchor flap 352P coupled to an opposite end of rear pad 353L along a second primary anchor flap fold line 352P', and a second auxiliary pad anchor flap 352A coupled to second primary pad anchor flap 352P along a second auxiliary anchor flap fold line 352A' as suggested in FIG. 11. When assembled, second auxiliary pad anchor flap 352A lies in a companion flap-receiving channel 352C.

Container 210 further includes a rear top closure 328T including a rear lid section 344, a right lid anchor tab 346R, and a left lid anchor tab 346L as shown, for example, in FIG. 11. Rear lid section 324 is pentagon-shaped in an illustrative embodiment and includes a trapezoid-shaped base 347 coupled to rear end wall 350 along closure fold line 350'C and an elongated rectangular wing 348 coupled to base 347 as suggested in FIG. 11. Right lid anchor tab 346R is coupled to a right end of wing 348 along a right wing fold line 346R' and sized and located to extend into slot 2342 (as suggested in FIGS. 9 and 10) to retain rear lid section 344 in a closed position relative to right side wall 234. Left lid anchor tab 346L is coupled to a left end of wing 338 along a left wing fold line 346L' and sized and located to extend into slot 2362 (as suggested in FIG. 10) to retain rear lid section 344 in a closed position relative to left side wall 236. Base 347 is separated from right corner stacking pad 353R by a right straight cut line 349R and from left corner stacking pad 353L by a left straight cut line 349L as suggested in FIGS. 9-11.

In an illustrative embodiment, the corrugation of blank 218 is positioned to run in a transverse direction TD as shown in insert A in FIG. 11. It is within the scope of the present disclosure to establish each of the fold lines disclosed herein by using score lines, creases, perforations, or perforations and score lines or by using another suitable technique.

Blank 218 is folded in a manner similar to that shown in FIGS. 4 and 5 to produce the container 210 shown in FIG. 10. Once blank 218 is folded, primary canopy anchor flaps 251P, 252P, 351P, and 352P are used to retain container 210 in an erected condition as suggested in FIG. 9. First primary pad anchor flap 251P is mated, e.g., adhered (using any suitable means), to right side wall 234 and second primary pad anchor flap 252P is mated, e.g., adhered (using any suitable means), to left side wall 236 to form front end closure 228E. Likewise, first primary pad anchor flap 351P is adhered (using any suitable means) to right side wall 234 and second primary pad anchor flap 352P is mated, e.g., adhered (using any suitable means), to left side wall 236 to form rear end closure 230E.

Next, all of the auxiliary pad anchor flaps 251A, 252A, 351A, and 352A are folded relative to companion primary pad anchor flaps 251P, 252P, 351P, and 352P and then moved into welcoming companion flap-receiving channels 51C, 52C, 151C, and 152C provided on opposite sides of front and rear end panels 50, 150 as suggested in FIGS. 9 and 10. This movement which is similar to the movement of an auxiliary pad anchor flap into a companion flap-receiving channel is shown in more detail in FIGS. 6-8 with respect to auxiliary pad anchor flap 51A and its companion flap-receiving channel 51C in the embodiment of FIGS. 1-8.

Figure 12:
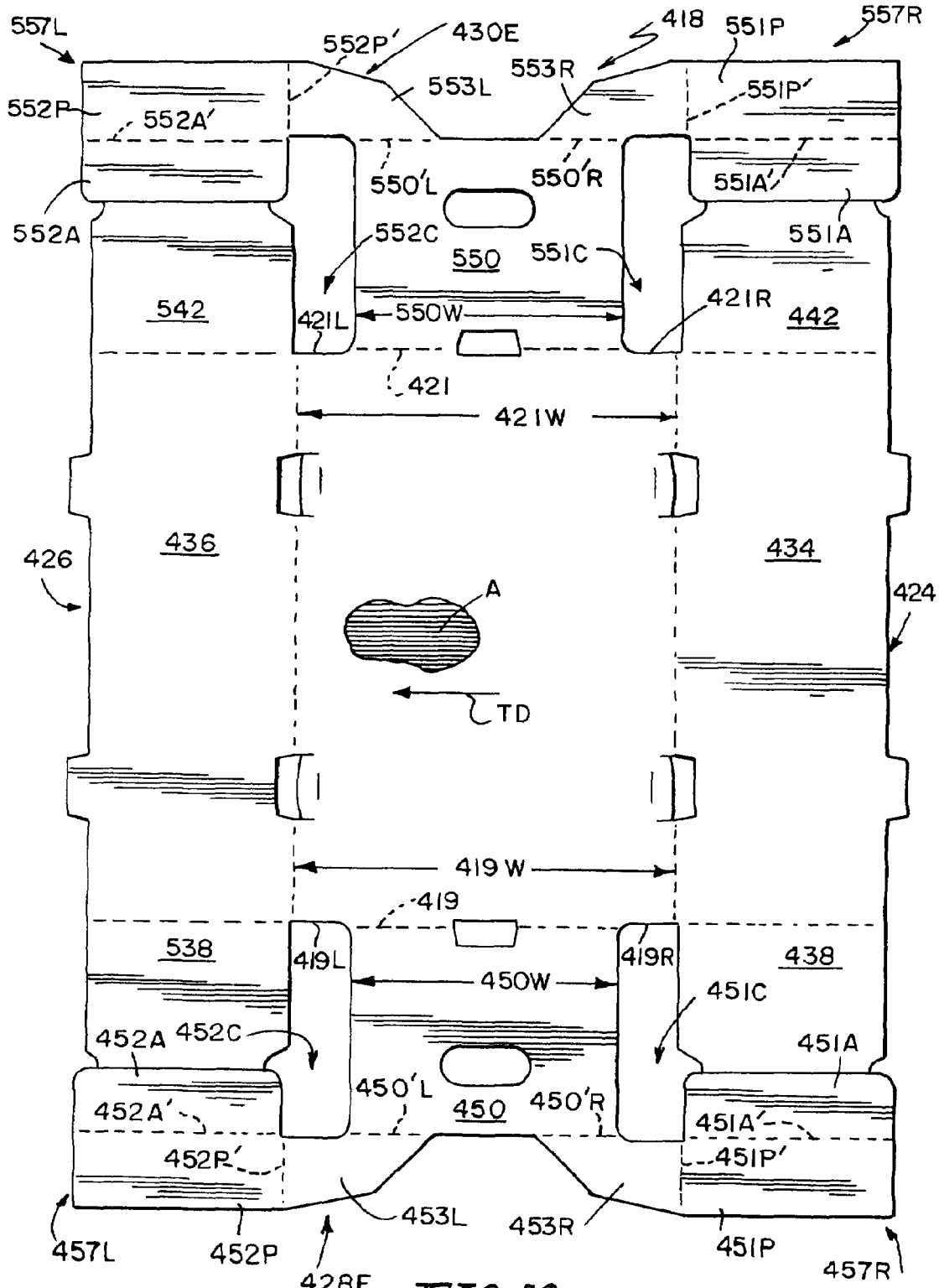
FIG. 12 is a plan view of a blank of corrugated material used to form an open container with monoplanar multipart end panels in accordance with a third embodiment of the present disclosure.

An opened container (not shown) in accordance with a third embodiment of the disclosure is made using a blank 418 shown in FIG. 12. This blank 418 is similar to blank 18 shown in FIG. 3 except that blank 418 is formed with stacking tabs and without any lids.

Blank 418 includes a floor 412 and a border coupled to floor 412 and configured to include a right side strip 424, a left side strip 426, a front end closure 428E, and a rear end closure 430E. Right side strip 424 includes a right side wall 434, a first front end wall anchor flap 438, and a first rear end wall anchor flap 442. Left side strip 426 includes a left side wall 436, a second front end wall anchor flap 538, and a second rear end wall anchor flap 542.

Front end closure 428E includes a narrow-width front end wall 450 coupled to one end of floor 412 along a first end fold line 419 and separate right and left front anchor strips 457R, 457L coupled to front end wall 450 along strip fold lines 450R and 450'L, respectively. The width 450W of front end wall 450 is narrow as compared to the width 419W of floor 412. Front anchor strips 457R, 457L provide means for anchoring front end wall 450 to each of right and left side walls 434, 436 to establish a front end of a container. In the illustrated embodiment, narrow-width front end wall 450 is centered relative to floor 412 along first end fold line 419 to produce front left edge 419L of floor 412 and front right edge 419R of floor 412. Front left edge 419L is about equal in length to front right edge 419R.

Right front anchor strip 457R includes a front right corner stacking pad 453R coupled to front end wall 450 along a front right anchor strip fold line 450'R, a first primary pad anchor flap 451P coupled to one edge of pad 453R along a first primary anchor flap fold line 451P', and a first auxiliary pad anchor flap 451A coupled to first primary canopy anchor flap 451P along a first auxiliary anchor flap fold line 451A'. First primary pad anchor flap 451P is adapted to mate with right side wall 434 and first auxiliary pad anchor flap 451A is adapted to mate with first front end wall anchor flap 438. When assembled, first auxiliary pad anchor flap 451A lies in a companion flap-receiving channel 451C.

Left front anchor strip 457L includes a front left corner stacking pad 453L coupled to front end wall 450 along a front left anchor strip fold line 450'L, a second primary pad anchor flap 452P coupled to one edge of pad 453L along a second primary anchor flap fold line 452P', and a second auxiliary pad anchor flap 452A coupled to second primary canopy anchor flap 452P along a second auxiliary anchor flap fold line 452A'. When assembled, second auxiliary pad anchor flap 452A lies in a companion flap-receiving channel 452C.

Rear end closure 430E includes a rear narrow-width end wall 550 coupled to an opposite end of floor 412 along a second end fold line 421 and separate right and left rear anchor strips 557R, 557L coupled to rear end wall 550 along strip fold lines 550R and 550'L, respectively. Rear anchor strips 557R, 557L provide means for anchoring rear end wall 550 to each of right and left side walls 434, 436 to establish a rear end of a container.

Rear end wall 550 has a width 550W that is less than the width 421W of floor 412 along second end fold line 421. In the illustrated embodiment, rear end wall 550 is centered relative to floor 412 along second end fold line 421 to produce rear left edge 421L of floor 412 and rear right edge 421R of floor 412. Rear left edge 421L is about equal in length to right rear edge 421R. Also, in the illustrated embodiment, width 419W is about equal to width 421W owing to the substantially uniform width of floor 412.

Right rear anchor strip 557R includes a rear right corner stacking pad 553R coupled to rear end wall 550 along a rear right anchor flap fold line 550'R, a first primary pad anchor flap 551P coupled to one edge of rear pad 553R along a first primary anchor flap fold line 551P', and a first auxiliary pad anchor flap 551A coupled to first primary pad anchor flap 551P along a first auxiliary anchor flap fold line 551A'. First primary pad anchor flap 551P is adapted to mate with right side wall 34 and first auxiliary pad anchor flap 551A is adapted to mate with first rear end wall anchor flap 542. When assembled, first auxiliary pad anchor flap 551A lies in a companion flap-receiving channel 551C.

Left front anchor strip 557L includes a rear left corner stacking pad 553L coupled to rear end wall 550 along a rear left anchor strip fold line 550'L, a second primary pad anchor flap 552P coupled to an opposite end of rear canopy 553 along a second primary anchor flap fold line 552P', and a second auxiliary pad anchor flap 552A coupled to second primary canopy anchor flap 552P along a second auxiliary anchor flap fold line 552A'. When assembled, second auxiliary pad anchor flap 552A lies in a companion flap-receiving channel 552C.

In an illustrative embodiment, the corrugation of blank 18 is positioned to run in a transverse direction TD as shown in insert A in FIG. 12. It is within the scope of the present disclosure to establish each of the fold lines disclosed herein by using score lines, creases, perforations, or perforations and score lines or by using another suitable technique.

Figure 13:
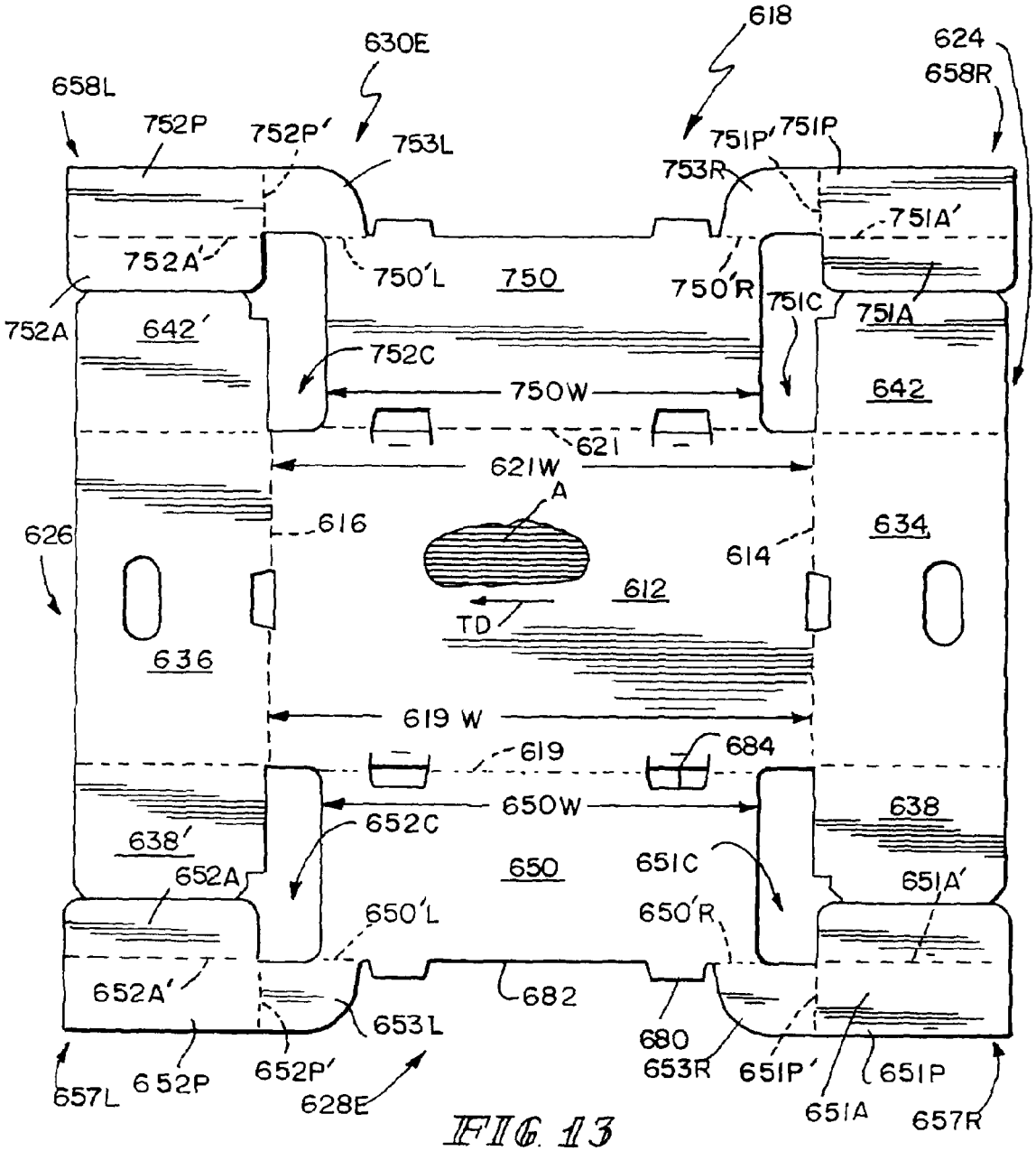
FIG. 13 is a plan view of a blank of corrugated material used to form an open container with monoplanar multipart end panels in accordance with a fourth embodiment of the present disclosure.

An opened container (not shown) in accordance with a fourth embodiment of the disclosure is made using a blank 618 shown in FIG. 13. This blank 618 is similar to blank 218 shown in FIG. 11 except that blank 618 is formed with stacking tabs and without any lids.

Blank 618 includes a floor 612, a right side strip 624, a left side strip 426, a front end closure 628E, and a rear end closure 630E. Right side strip 624 includes a right side wall 634, a first front end wall anchor flap 638, and a first rear end wall anchor flap 642. Left side strip 626 includes a left side wall 636, a second front end wall anchor flap 638', and a second rear end wall anchor flap 642'.

Right side strip 624 includes a right side wall 634, a first front end wall anchor flap 638, and a first rear end wall anchor flap 642. Right side wall 634 is appended to floor 612 along a first side fold line 614.

Left side strip 626 includes a left side wall 636, a second front end wall anchor flap 638', and a second rear end wall anchor flap 642'. Left side wall 636 is appended to floor 612 along a second side fold line 616.

Front end closure 628E includes a narrow-width front end wall 650 coupled to one end of floor 612 along a first end fold line 619 and right and left front anchor strips 657R, 657L coupled to front end wall 650 along strip fold lines 650R and 650'L, respectively. The width 650W of front end wall 650 is narrow as compared to the width 619W of floor 612. Front anchor strips 657R, 657L provide means for anchoring front end wall 650 to each of right and left side walls 634, 636 to establish a front end of a container.

Front end closure 628E further includes a front stacking tab 680 appended to an edge 682 of narrow-width front end wall 650 as shown in FIG. 13. Front stacking tab 680 is arranged to lie in a space provided between right and left anchor strip fold lines 650R and 650'L as shown in FIG. 13. Narrow-width front end wall 650 is also formed to include a tab receiver 684 located along end fold line 619 and formed to provide means for receiving a front stacking tab (like tab 680) of an underlying container (not shown).

Right front anchor strip 657 includes a front right corner stacking pad 653R coupled to front end wall 650 along a front right anchor strip fold line 650'R, a first primary pad anchor flap 651P coupled to one edge of front pad 653R along a first primary anchor flap fold line 651P', and a first auxiliary pad anchor flap 651A coupled to first primary anchor flap 651P along a first auxiliary anchor flap fold line 651A'. When assembled, first auxiliary pad anchor flap 651A lies in a companion flap-receiving channel 651C.

Left front anchor strip 657L includes a front left corner stacking pad 653L coupled to front end wall 650 along a front left anchor strip fold line 650'L, a second primary pad anchor flap 652P coupled to an opposite end of front pad 653L along a second primary anchor flap fold line 652P', and a second auxiliary pad anchor flap 652A coupled to second primary pad anchor flap 652P along a second auxiliary anchor flap fold line 652A'. When assembled, second auxiliary pad anchor flap 652A lies in a companion flap-receiving channel 652C.

Rear end closure 630E includes a rear narrow-width end wall 750 coupled to an opposite end of floor 612 along a second end fold line 621, a right rear anchor strip 658R coupled to rear end wall 750 along a strip fold line 750R, and a left rear anchor strip 658L coupled to rear end wall 750 along a strip fold line 750'L. Right and left rear anchor strips 6258R, 658L cooperate to provide means for anchoring rear end wall 750 to each of right and left side walls 634, 636 to establish a rear end of a container.

Right rear anchor strip 658R includes a rear right corner stacking pad 753R coupled to end wall 750 along a rear right anchor flap fold line 750R', a first primary pad anchor flap 751P coupled to one edge of rear pad 753R along a first primary anchor flap fold line 751P', and first auxiliary pad anchor flap 751A coupled to first primary pad anchor flap 751P along a first auxiliary anchor flap fold line 751A'. When assembled, first auxiliary pad anchor flap 751A lies in a companion flap-receiving channel 751C.

Left rear anchor strip 658L includes a rear left corner stacking pad 753L coupled to rear end wall 750 along a left right anchor flap fold line 750'L, a second primary canopy anchor flap 752P coupled to an opposite end of rear canopy 753L along a second primary anchor flap fold line 752P', and a second auxiliary pad anchor flap 752A coupled to second primary pad anchor flap 752P along a second auxiliary anchor flap fold line 752A'. When assembled, second auxiliary pad anchor flap 752A lies in a companion flap-receiving channel 752C.

In an illustrative embodiment, the corrugation of blank 618 is positioned to run in a transverse direction TD as shown in insert A in FIG. 13. It is within the scope of the present disclosure to establish each of the fold lines disclosed herein by using score lines, creases, perforations, or perforations and score lines or by using another suitable technique.

Customers are always seeking stronger packages that use lighter weight material combinations to be able to reduce their packaging cost, while delivering a superior product to the market. Corrugated companies have responded over the years by providing structures of increasing complexity, particularly in the corner structural areas where the stacking strength of the package is often concentrated. In a number of examples, these strategies have greatly increased the strength of the package, but this goal has come at a cost, in that the number of layers of corrugated board in the package have increased between the product on the inside of the carton and the outside dimension of the package. This can have a negative effect on palletization and performance, as pallet fit can be compromised with the added layers, particularly when multiple packages are arranged on a pallet. The added layers of material can result in overhang, which not only compromises the stacking strength of the container, but may result in damage to the product. In addition, proper package fit with primary packages may be made difficult when adding additional layers of material and trying to hold firm on an established outside box dimension. Therefore, it would be desirable to have a box design that would offer the structural strength and design attributes, without the added layers of material between the product and outside of the package.

In accordance with the present disclosure, oversized slots between side or end walls and the corresponding minor flaps that fold to the inside of the container, as well as the removal of the exterior flap offsets from the end or side flap areas allow the exterior wraparound corner flap to fit and attach directly to the inside minor flap, rather than the outside wall of the container. This effectively allows this wraparound flap component to reside inward of the end wall, on the same plane as the end wall, making it flush with the end wall, and effectively eliminating one layer of board from each end or side of the container. While this may seem like a trivial gain, effectively eliminating a layer of board on each side or end of the package can gain the customer between ⅜ inch and ⅝ inch per box. If there are several boxes per row arranged on a pallet, this gain can be significant and a critical improvement in keeping the boxes inside the edge of the pallet.

The invention claimed is:

1. An article-transport container comprising a floor having two sides and two ends and a border coupled to the floor and arranged to cooperate with the floor to form an interior region adapted to contain articles, the border including a right side strip coupled to a first side of the floor along a first side fold line, a left side strip coupled to a second side of the floor along a second side fold line, and a front end closure coupled to a first end of the floor along an end fold line, wherein the front end closure includes a narrow-width front end wall coupled to the first end of the floor along the end fold line, a right front anchor strip coupled to the narrow-width front end wall along a right anchor strip fold line, and a left front anchor strip coupled to the narrow-width front end wall along a left anchor strip fold line, the right front anchor strip is coupled to the right side strip to anchor the narrow-width front end wall to the right side strip to retain the narrow-width front end wall in substantially perpendicular relation relative to the floor to establish an upright orientation of the narrow-diameter front end wall, the left front anchor strip is coupled to the left side strip to anchor the narrow-width front end wall to the left side strip to retain the narrow-width front end wall in the upright orientation, and the right front anchor strip includes a front right corner stacking pad arranged to lie in spaced-apart substantially parallel relation to the floor, a first primary pad anchor flap coupled to the front right corner stacking pad and arranged to lie in substantially perpendicular relation to the front right corner stacking pad and along a portion of the right side strip, and a first auxiliary pad anchor flap coupled to the first primary pad anchor flap, and wherein each of the narrow-width front end wall and the first auxiliary pad anchor flap includes an exterior surface facing away from the interior region and lying substantially in a single plane.

2. The container of claim 1, wherein the front right corner stacking pad is coupled to the narrow-width front end wall along a front right anchor strip fold line.

3. The container of claim 2, wherein the front right corner stacking pad is arranged to lie in substantially perpendicular relation to the narrow-width front end wall.

4. The container of claim 2, wherein the left front anchor strip includes a front left corner stacking pad coupled to the narrow-width front end wall along a front left anchor strip fold line and arranged to lie in substantially spaced-apart relation to the front right corner stacking pad and in substantially spaced-apart parallel relation to the floor.

5. The container of claim 4, further comprising a front lid section comprising a base coupled to an edge of the narrow-width front end wall, a wing coupled to the base to locate the base between the narrow-width front end wall and the wing, a right lid anchor flap coupled to a free right end of the wing along a right wing fold line, and a left lid anchor flap coupled to a free left end of the wing along a left wing fold line, and wherein the base and the wing are arranged to overlie the floor to cover a portion of the interior region of the container, the right lid anchor flap is coupled to the right side strip to retain the base and the wing in a stationary position relative to the floor, and the left lid anchor flap is coupled to the left side strip to retain the base and the wing in a stationary position relative to the floor.

6. The container of claim 5, wherein the base and the wing cooperate to form a T-shaped cover and the base is arranged to lie between the right and left corner stacking pads.

7. The container of claim 5, wherein the base is separated from the right corner stacking pad by a right curved cut line and from the left corner stacking pad by a left curved cut line.

8. The container of claim 5, wherein the base has a trapezoidal shape.

9. The container of claim 5, wherein the base has a first edge coupled to the narrow-width front end wall and a second edge coupled to the wing and the second edge is longer than the first edge.

10. The container of claim 5, wherein the right side strip is formed to include a tab-receiving slot and the right lid anchor flap is a right lid anchor tab arranged to extend into the tab-receiving slot.

11. The container of claim 2, wherein the first primary pad anchor flap is coupled to the front right corner stacking pad along a primary anchor flap fold line and coupled to the portion of the right side strip.

12. The container of claim 11, wherein the first primary pad anchor flap is arranged to lie in substantially perpendicular relation to each of the front right corner stacking pad and the narrow-width front end wall.

13. The container of claim 11, wherein the first auxiliary pad anchor flap is coupled to an edge of the first primary pad anchor flap along an auxiliary anchor flap fold line and coupled to another portion of the right side strip.

14. The container of claim 13, wherein the first auxiliary pad anchor flap is arranged to lie in substantially perpendicular relation to each of the front right corner stacking pad and the first primary pad anchor flap.

15. The container of claim 13, wherein the right side strip includes a right side wall coupled to the floor along the first side fold line to provide the portion of the right side strip and a first front end wall anchor flap arranged to lie in substantially perpendicular relation to the right side wall to provide another portion of the right side strip, and the first auxiliary pad anchor flap is coupled to the first front end wall anchor flap.

16. The container of claim 15, wherein the first primary pad anchor flap is coupled to the right side wall.

17. The container of claim 11, wherein the right side strip includes a right side wall coupled to the floor along the first side fold line to provide the portion of the right side strip and a first front end wall anchor flap coupled to the right side wall along a fold line and arranged to lie in substantially perpendicular relation to the right side wall and wherein the first primary pad anchor flap is coupled to the right side wall.

18. The container of claim 17, wherein the right front anchor strip further includes a first auxiliary pad anchor flap coupled to the first primary pad anchor flap during an auxiliary anchor flap fold line and coupled to the first front end wall anchor flap.

19. The container of claim 1, wherein the left front anchor strip includes a front left corner stacking pad arranged to lie in spaced-apart substantially parallel relation to the floor and in spaced-apart substantially coplanar relation to the front right corner stacking pad.

20. The container of claim 19, wherein the front left corner stacking pad is coupled to the narrow-width front end wall along a left anchor strip fold line.

21. The container of claim 20, wherein the front end closure further includes a front stacking tab appended to an edge of the narrow-width front end wall and arranged to lie in a space provided between the right and left anchor strip fold lines and the narrow-width front end wall is formed to include a tab receiver located along the end fold line and formed to provide means for receiving a front stacking tab of an underlying container.

22. The container of claim 19, wherein the left front anchor strip further includes a second primary pad anchor flap coupled to an edge of the front left corner stacking pad along a primary anchor flap fold line and coupled to the left side strip.

23. An article-transport container comprising a floor and a border coupled to the floor and arranged to cooperate with the floor to form an interior region adapted to contain articles, the border including a right side wall coupled to the floor, a left side wall coupled to the floor, and a front end closure coupled to the floor and to each of the right and left side walls, wherein the front end closure includes a narrow-width front end wall coupled to the floor and separate right and left anchor strips coupled to the narrow-width front end wall, the right anchor strip is coupled to the right side wall and the left anchor strip is coupled to the left side wall to retain the narrow-width front end wall in an upright orientation relative to the floor and in fixed relation to each of the right and left side walls, and each of the right and left anchor strips of the front end closure includes a corner stacking pad arranged to lie in substantially spaced-apart parallel relation to the floor, a first primary pad anchor flap coupled to the front right corner stacking pad and arranged to lie in substantially perpendicular relation to the front right corner stacking pad and along a right side wall and a first auxiliary pad anchor flap coupled to the first primary pad anchor flap, and wherein each of the narrow-width front end wall and the first auxiliary pad anchor flap includes an exterior surface facing away from the interior region and lying substantially in a single plane.

24. The container of claim 23, wherein the border further includes a rear end closure coupled to the floor and to each of the right and left side walls, wherein the rear end closure includes a narrow-width rear end wall coupled to the floor and separate right and left anchor strips coupled to the narrow-width rear end wall, the right anchor strip of the rear end closure is coupled to the right side wall and the left anchor strip of the rear end closure is coupled to the left side wall to retain the narrow-width rear end wall in an upright orientation relative to the floor and in fixed relation to each of the right and left side walls, and each of the right and left anchor strips of the rear end closure includes a corner stacking pad arranged to lie in substantially spaced-apart parallel relation to the floor.

25. The container of claim 24, further comprising a top closure coupled to the front and rear end closures, wherein the top closure includes a rear lid section comprising a rear base coupled to an edge of the narrow-width rear end wall, a rear wing coupled to the rear base to locate the rear base between the narrow-width rear end wall and the rear wing, a right lid anchor flap coupled to a free right end of the rear wing along a right wing fold line, and a left lid anchor flap coupled to a free left end of the rear wing along a left wing fold line, and wherein the rear base and the rear wing are arranged to overlie the floor to cover a portion of the interior region of the container, the right lid anchor flap is coupled to the right side strip to retain the rear base and the rear wing in a stationary position relative to the floor and the left lid anchor flap is coupled to the left side strip to retain the rear base and the rear wing in a stationary position relative to the floor, and wherein the top closure includes a front lid section comprising a front base coupled to an edge of the narrow-width front end wall, a front wing coupled to the front base to locate the front base between the narrow-width front end wall and the front wing, a right lid anchor flap coupled to a free right end of the front wing along a right wing fold line, and a left lid anchor flap coupled to a free left end of the front wing along a left wing fold line, and wherein the front base and the front wing are arranged to overlie the floor to cover a portion of the interior region of the container, the right lid anchor flap is coupled to the right side strip to retain the front base and the front wing in a stationary position relative to the floor and the left lid anchor flap is coupled to the left side strip to retain the front base and the front wing in a stationary position relative to the floor.

* * * * *